US005657529A

United States Patent [19]

Bohn et al.

[11] Patent Number: 5,657,529

[45] Date of Patent: Aug. 19, 1997

[54] MODULAR CONVEYING APPARATUS

[75] Inventors: Martin Bohn, Reutlingen; Wolfgang Scheller, Oberpleichfeld; Klaus Hoerz, Neuffen, all of Germany

[73] Assignee: bielomatik Leuze GmbH & Co., Neuffen, Germany

[21] Appl. No.: 399,840

[22] Filed: Mar. 7, 1995

[30] Foreign Application Priority Data

Mar. 26, 1994 [DE] Germany ..... 44 10 577.0

[51] Int. Cl.[6] ..... B21B 31/10; B21B 31/22; B41F 3/48

[52] U.S. Cl. ..... 29/563; 29/33 S; 29/33 Q; 29/564; 72/238; 72/239; 72/446; 226/101; 493/477; 493/478

[58] Field of Search ..... 493/477, 478, 493/479, 480; 29/33 S, 33 Q, 563, 564; 72/238, 239, 446; 226/101, 200

[56] References Cited

U.S. PATENT DOCUMENTS

| | | | |
|---|---|---|---|
| 4,052,601 | 10/1977 | Corni | 29/563 |
| 4,413,541 | 11/1983 | Biggar, III | 83/346 |
| 4,502,384 | 3/1985 | Habluetzel | 101/153 |
| 4,618,342 | 10/1986 | Borel | 493/30 |
| 4,648,540 | 3/1987 | Steidel | 226/111 |
| 4,677,733 | 7/1987 | Andersson | 29/563 |
| 4,805,501 | 2/1989 | Nuttin | 83/300 |
| 4,887,529 | 12/1989 | Ichikawa et al. . | |
| 4,968,292 | 11/1990 | Takeda | 493/477 |
| 5,060,569 | 10/1991 | Gladow | 101/216 |
| 5,162,034 | 11/1992 | Rau et al. | 493/395 |
| 5,350,348 | 9/1994 | Guiot | 493/477 |

FOREIGN PATENT DOCUMENTS

| | | |
|---|---|---|
| 183336 | 6/1986 | European Pat. Off. . |
| 308942 | 3/1989 | European Pat. Off. . |
| 478903 | 4/1992 | European Pat. Off. . |
| 1436909 | 4/1969 | Germany . |
| 2353563 | 5/1974 | Germany . |
| 2848134 | 10/1979 | Germany . |
| 3334426 | 4/1985 | Germany . |
| 3420763 | 12/1985 | Germany . |
| 2046664 | 11/1980 | United Kingdom . |

*Primary Examiner*—Daniel W. Howell
*Assistant Examiner*—Christopher Kirkman
*Attorney, Agent, or Firm*—Quarles & Brady

[57] ABSTRACT

In a production line both the base frame and also the working area is subdivided into modular assemblable modules, the base unit having three reception positions which can be provided with slide-in working units and receptacles for driving units and a trolley transferring the particular working unit. The working unit, after a control console has moved out of the sliding in path, can be moved in and out parallel to the horizontal separating plane and transversely to the conveying direction and can then be adjusted and locked. Thus, with the same base units a randomly long basic frame can be created for randomly succeeding working stations.

27 Claims, 7 Drawing Sheets

MODULAR CONVEYING APPARATUS

BACKGROUND OF THE INVENTION

The invention relates to an apparatus or units for processing or working layer material or the like, particularly substrate materials. Such sheet-like materials can be made from paper, plastics, etc. and are of relatively high flexibility, so that they can be folded without breaking or can be closely curved or bent with a radius of a few millimetres without permanent deformation. The material can be supplied as a web from a storage means, e.g. in reel and/or folding layer form and in one or more working stations can successively undergo different treatments or workings in continuous manner, e.g. in such a way that at the end individual, separate sheet layers are obtained, which can in turn be combined in multilayer form. In the case of a multilayer the individual layers despite different workings can pass through jointly or approximately congruently the said apparatus. The layer material can also be supplied in the form of individual sheet layers or blanks or as a strand of sheet layers to the apparatus.

With in each case one or more separate working units e.g. there can be a web edge alignment, a web advance, a longitudinal or transverse processing, such as cutting, perforating, grooving, crimping, gluing, printing, embossing, contour cutting or punching and the like. In addition, prefabricated or also continuously separately produced product parts such as inspection window foils, longitudinal strips, etc. can be brought together with the layer material. Sheet layers or web portions can also be brought together, e.g. scaled in mutually overlapping manner or can be placed approximately flush on one another to form multiple sets or finished articles or products can be placed in a pack and consequently packed. For said treatments usually driven tools are required, but it is also possible to provide working stations in which treatment requires no tool drive, but instead merely the conveying movement of the layer material, which is e.g. the case with folding, combining, deflecting or turning.

In the case of such apparatuses or production lines there is a need for a building block or modular construction, in that on an apparatus bed or on a base standing on the foundation floor, as a function of the work to be carried out, are successively arranged the appropriate working units in the desired number and then the layer material can pass through at roughly the same height along a common conveyor. For changes to the workings random working units are to be interchangeable or replaceable by other units and the number of working units present or the length of the apparatus is to be variable. As the working units and optionally conveying means are mostly driven in reciprocal dependence or jointly, the associated driving or control means must be correspondingly modifiable. This applies to the working units through which pass the layer material and also the base frame through which the layer material does not pass or only does so for supply removal, deflection or similar purposes and which mainly determines the positionally fixed association of the working units and their spacings, as well as containing driving and control means.

OBJECTS OF THE INVENTION

An object of the invention is to provide an apparatus, particularly a working unit and/or base unit, in which disadvantages of known constructions are avoided and advantages of the aforementioned type can be obtained and in which in particular through a simple combinability or replaceability a universal construction of the individual preassembled or substantially ready-to-operate subassemblies is randomly possible.

SUMMARY OF THE INVENTION

According to the invention at least one partial unit of the working unit is constructed as an insertion unit, which has guiding and support means in such a way that it can be moved from a completely separated state with respect to the base frame and brought together supported by the latter and is then guided on the base frame into its working position, after which the slidein unit by bracing or the like is to be fixed in its working position with respect to the base frame. The sliding in direction is appropriately transversely or at right angles to the conveying direction, approximately parallel to the associated running plane of the layer material and/or the sliding in direction diverges from the vertical, an approximately horizontal sliding in direction being particularly suitable.

The slide-in unit is usually elongated transversely to the conveying direction, so that on insertion it can be supported by one end on guides of the base frame in the vicinity of one of its outer longitudinal sides and can then be brought over the sliding in path into increasing engagement with said guides until it extends over most of the base frame width.

The slide-in unit is appropriately substantially completely located above the top of the base frame, so that between the same there is a substantially parallel or horizontal separating plane with respect to the associated layer plane and in the vicinity thereof the interengaging assembly coupling members of the slide-in unit and base frame are located. The guidance and couplings members of the slide-in unit can consequently be located on its bottom outside, whereas the corresponding members of the base frame can be located on its top side. This also applies with respect to the centring, fixing or positioning means with which the complete slide-in unit is to be oriented and fixed with respect to the base frame.

Like other subassemblies of the apparatus the slide-in unit is appropriately detachable or easily detachable and fixable. This is understood to mean a detachability or fixability of a non-destructive nature, whose operation in the working position or in the disassembled position is freely accessible from the outside, whose operation is substantially drive or tool-free or can take place manually, the detachable connection at least partly taking place in self-engaging manner by the sliding-in movement or in self-disengaging manner by the opposite sliding-out movement. Said members are advantageously constructed in such a way that the slide-in unit can perform the sliding-in movement substantially continuously or steplessly with respect to the base frame initially without or with lateral guidance and then towards the end of the sliding-in movement by centring or the like is so locked in or opposite to the sliding-in movement under its own weight that for overcoming the locking an increased thrust force is required, after which the slide-in unit is adjustable in several directions in much smaller positioning paths with respect to the sliding in path and finally is to be positionally rigidly fixed in the adjusted position relative to the base frame. The adjusting directions can be in one of the aforementioned directions, e.g. parallel to the sliding in direction, in the conveying direction and about a positioning axis of an imaginary nature transversely or at right angles to the associated conveying or separating plane and within all the outsides of the slide-in unit.

The slide-in unit is appropriately constructed in such a way that its underside or said members form a standing surface with which the slide-in unit without damage to any components can be placed in inherently stable manner on a planar positioning surface and in this way stored. If the slide-in unit has rolling or track-maintaining running members projecting over its underside, then it can be brought into any desired position by easy movement on the base frame and also on the positioning surface in the form of a trolley at least three or at the most four running members located in the angles of an imaginary rectangle can bring about the sole weight support of the slide-in unit with respect to the base frame or positioning surface and/or form sliding skids for the transverse movement of the slide-in unit with respect to each of the said positioning surfaces.

The slide-in unit appropriately has a dimensionally rigid, preassembled frame with plate-like side walls on the ends, the side walls being stiffened with respect to one another by positionally rigid connections and the frame or side walls serve for fixing or mounting tools, which are located in lateral and/or longitudinal view of the apparatus completely outside the base frame and spaced therefrom.

Particularly if the working unit has two or more separately fixed or mounted tools or the like, it can also be assembled from preassembled subassemblies, whereof one or more in each case contains one of these tools, but only a single tool is to be directly connected to the base frame or has the members for this purpose. The other subassembly is then exclusively carried by the slide-in assembly carrying the slide-in means and is then easily detachable or replaceable with respect thereto if it is connected to the base frame in or out of the working position. Side walls of the subassembly of the working unit or base frame are approximately parallel or equiplanar in the working position, which gives a very compact construction. The assembly of the working unit is detachable from its slide-in assembly appropriately transversely to the sliding in direction, transversely to the associated conveying plane and/or transversely to said separating plane, whereby the separating plane can assume between the assemblies of the working unit each of the positions or orientations, which are described with the aid of the separating plane between the slide-in assembly or basic group and the base frame.

Spaced from the particular separating plane the working unit appropriately forms between its frame walls an e.g. gap-like passage for the layer material, in which the latter is guided or treated in the associated conveying plane or is processed continuously. Thus, tools do not project above those frame undersides which form connecting surfaces associated with the separating plane, so that said undersides can form inherently stable standing surfaces of the indicated type.

Although conceivable, driving and control means, at least to the extent that they are used for tools acting directly on the layer material in the conveying plane, are essentially not provided on the working unit, but for the synchronous operation of two or more such tools the associated transmission gear can belong directly to the slide-in assembly. This gear or a drive-in roll for the particular tool is advantageously located directly on the outside of the rear frame wall of the slide-in unit and the roll can be in the form of a wheel and can be rigidly connected to the tool in a direct manner without an intermediate gear.

Said mechanical driving and control means advantageously also form a preassembled assembly, e.g. of intermediate gear and rotation superimposing gear with associated control drive or a dynamically controllable or regularable direct drive motor, said subassembly being easily detachable, e.g. replaceable against a shaft portion, which, in the same way as the aforementioned subassembly, then produces the driving connection to shaft portions of a driving shaft located on one or both sides. The associated conveying plane can be defined as that plane which is assumed by the layer material on entering or leaving the working unit or connecting these areas connected from the outside to the working unit and between them within the working unit the layer material can be so deflected one or more times that the two said areas are parallel displaced with respect to one another.

The apparatus according to the invention can also be formed solely by the base frame, which is adapted for supporting reception on at least one working unit. The base frame has as a preassembled unit a base unit with a plurality, particularly at the most five and at the least two, preferably three, conveying direction-spaced, succeeding reception places for in each case one working unit, the intermediate spacing being approximately the same as the associated extension of a working unit. As a function of requirements the places or positions can be occupied by a working unit or left free, so that the layer material then runs past the free position in contact-free, stretched manner.

Each position can be continuously or e.g. in two stages to working units of different size in the conveying direction or can be positionally varied with respect to the base frame roughly parallel to the conveying direction, so that there are numerous adaptation possibilities to the most varied requirements and also adequate free space can be created in order to maintain adequately manually accessible the sides of the particular working unit positioned transversely to the conveying direction, e.g. for reequipping. For the supporting reception of the working unit the reception position appropriately has exclusively approximately parallel or identical crossbars, which independently of one another are positionally variable roughly by their width and only interconnected by the frame wall. With the working unit mounted said crossbars are additionally clearance-free transversely connected or braced in certain areas by a frame-like base plate of the working unit and are located in spaced manner from the inside of the frame wall. The frame of the working unit and the frame of the base unit reciprocally stiffen one another, so that a very light construction is possible.

The base unit has at one or both ends connecting means for the aligned and dimensionally stiff connection to an identical base unit to be connected in the longitudinal direction, so that the base frame can be randomly extended and shortened. The connecting means are designed in such a way that adjacent base units can be assembled and disassembled in reciprocal operating position in the direction described by means of the slide-in unit or parallel to the standing plane and transversely to the longitudinal direction thereof. Thus, e.g. a base unit located between further base units can be removed without any position change of the two further base units and replaced by another unit.

The base unit assembly also includes bearing means for a driving shaft roughly parallel to the conveying direction or the reception means for in each case one driving unit for each reception location. The driving shaft is assembled from shaft sections connected together in the longitudinal direction and is located on the outside of the rear frame wall remote from the operating side of the apparatus, so that the space on the inside of the frame wall remains free for guiding layer material, which within the base frame and between the frame walls can be deflected, turned, supplied, bypass a working unit, etc. The shaft sections are to be fitted in easily detachable manner in one of the indicated directions, so that for the assembly of an intermediate section the two connecting sections need not be moved in their longitudinal direction.

The driving unit, particularly an angular or mitre gear with shaft journals directed away from one another for connection to the shaft sections, can be rotatable about an angle of at least 180° or 360°, without other movements, about a turning axis which is at right angles, particularly roughly parallel to the conveying plane or horizontal to the common axis of said journals and can then be retightened, so that in simple manner the rotation direction of the journal of the driving unit located in this axis can be reversed for the same drive rotation direction.

All the mechanical, electrical, pneumatic or hydraulic connections and actuations necessary for the assembly or operation of a working unit are formed by easily detachable or actuatable interfaces, which with the exception of the driving connection with the driving unit can be achieved by a single operator from a single location, namely from the front of the particular frame from which the working unit is introduced. Corresponding attaching plugs, plug couplings, positioning and operating handles, etc. are positioned on the front of the working unit just below the separating or running plane of the slide-in unit in the vicinity of a table surface, which the base frame forms upstream of the working unit and approximately connected thereto. Therefor the working unit can be very rapidly removed, inserted, braced, connected and put into operation, as well as functionally influenced in operation by manual control.

For this functional influencing for two or more reception positions there is appropriately a common hand control, e.g. roughly level with the working unit above the base frame a control console is provided, which continuously and without any interruption of its control lines can be moved in the conveying direction and in front of each reception position approximately over the entire length of the base unit or base frame into and out of the sliding in path of the particular working unit. By a pre-selection handle said manual or hand control can control the particular working unit and then influence same with the remaining control handles, e.g. keys or buttons.

For at least two, more or all the working units or stations or reception positions to be controlled there is a common, computer-aided control device, which operates in the manner of a collision network in a two-wire system and is therefore to be adapted to all requirements. This control device has a main unit, e.g. in a switch cabinet, remote therefrom and connected thereto in the vicinity of the operating side of the device a guidance unit with a manual main operating console and at least one of the said manual controls, each of these three units containing a memory programmable control and said units are connected in series or in circular manner in the form of a control bus. Therefore the individual memory programmable controls can be easily switched on or off or removed or bridged or introduced in circular manner by means of plug connections or interfaces.

As a result of the two-wire connection of the individual controls of each base unit during assembly the only other wiring expenditure is for the voltage supply for the drive power, optionally different control voltages, as well as the wiring for an emergency cutout. The guidance unit is responsible for control functions common to all the associated working units, such as e.g. the switching on or off or changes to the conveying speed. This also applies with respect to the correct register regulation of the drawing in of layer material into the apparatus or for regulating the tension of the layer material in the vicinity of the working units.

The working units are easily reciprocally interchangeable without any change being required to the control device, because each of the memory programmable controls contains the same program and in the associated connecting plug a module identifier, on the basis of which it can be controlled from the control device in the manner intended for its working unit. The control device operates according to the master-slave principle, the main unit acting as the master control, the guidance means as the slave control and the manual controls as individual slave controls. All the informations of all the controls located in the data bus are consequently continuously available to all the controls, which in turn feed all the detected state changes into the data bus.

As a result of the construction according to the invention a universal module is provided for the processing of starting material, particularly for paper processing. The particular device assembled from these modules is subdivided into several functional groups, e.g. rolling, processing, drying, laying out, further processing, etc. with respect to the layer material, which for each random application allows reequipping to a different configuration or processing sequence or quality.

The supporting or bearing part of the base frame can comprise only two one-piece, spaced side wall plates transversely strutted by rods above the standing plane. The base frame contains the reception positions in a longitudinal grid of e.g. approximately 600 mm, the driving shafts of several base units being drivable by means of a common main drive motor, which is e.g. fixed to the first base unit in the conveying direction and/or at least one further base unit. The working width available which is smaller than the inside width or diameter of the particular frame can be approximately 660 mm, so that in the case of A4 format productions multiple working is possible, e.g. in three-use juxtaposed manner. All the given characteristics, dimensions, etc. can be provided in an approximate manner, substantially or identically to those described or also significantly varying therefrom.

BRIEF FIGURE DESCRIPTION

These and further features can be gathered from the claims, description and drawings and the individual features, either individually or in the form of subcombinations, can be implemented in an embodiment of the invention and in other fields and can represent advantageous, independently protectable constructions for which protection is hereby claimed. Embodiments of the invention are described in greater detail hereinafter relative to the drawings, wherein show:

FIG. 1 An apparatus assembled from modules according to the invention in perspective view.

FIG. 2 A unit of the apparatus of FIG. 1 in perspective view from the front.

FIG. 3 The unit of FIG. 2 in perspective view from the rear.

FIG. 4 A detail of FIG. 2 in a view from the front.

FIG. 5 The detail of FIG. 4 in plan view.

FIG. 6 The working unit seen in the conveying direction.

FIG. 7 The working unit of FIG. 6 in side view.

FIG. 8 Parts of the unit of FIG. 6 in plan view.

DETAILED DESCRIPTION OF PREFERRED EXAMPLE EMBODIMENTS

Figure 1:
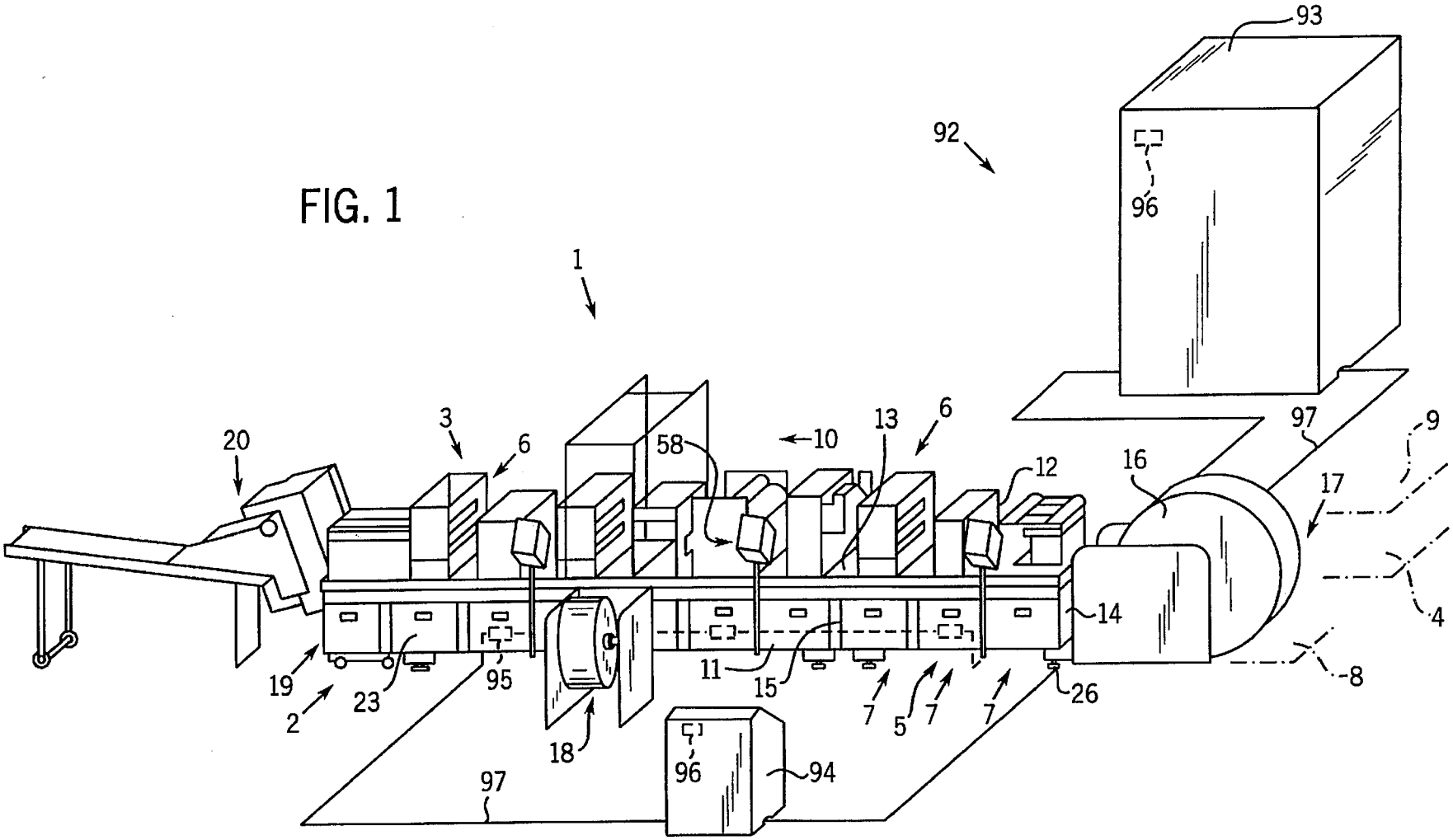
Figure 2:
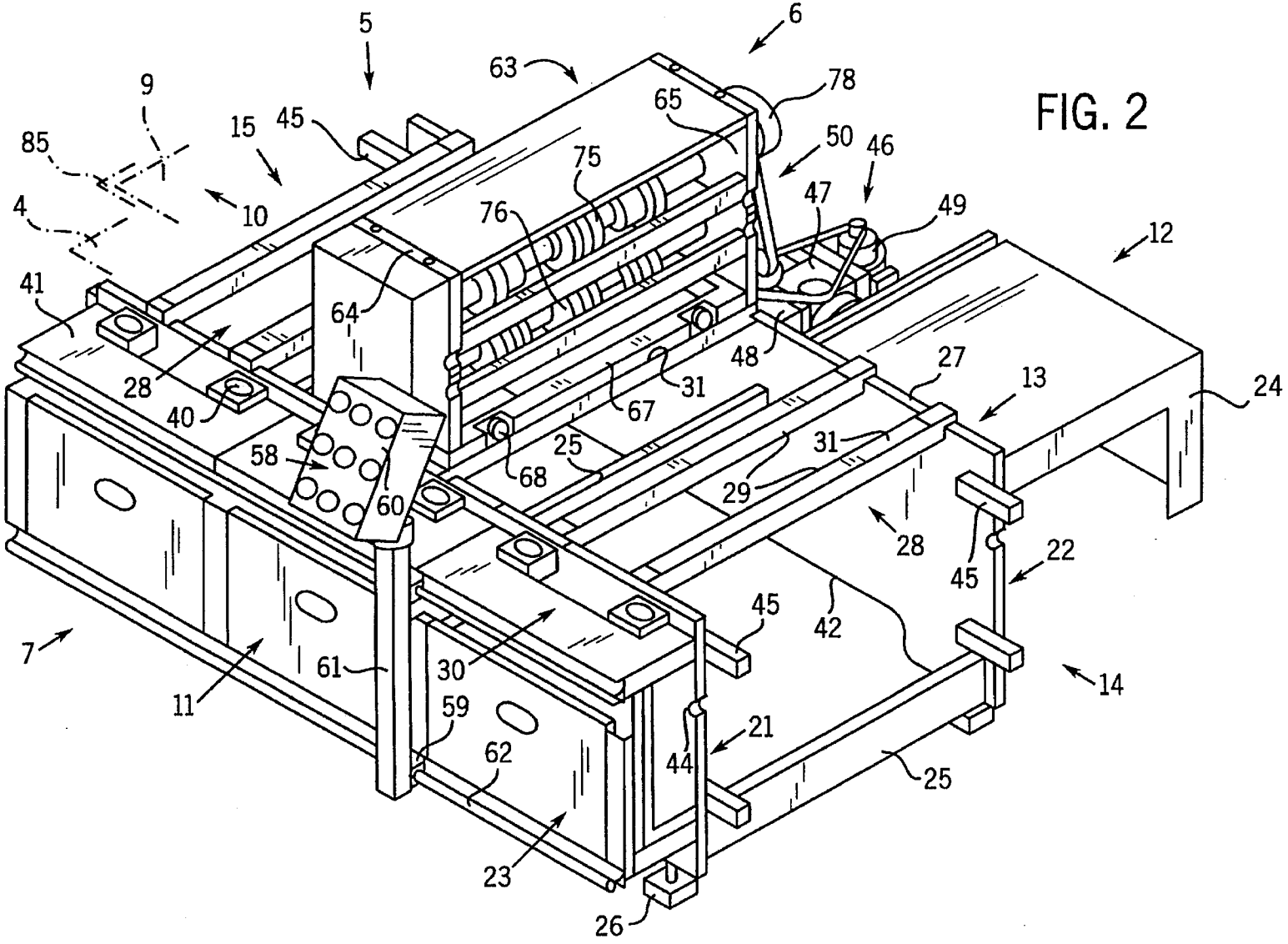
Figure 3:
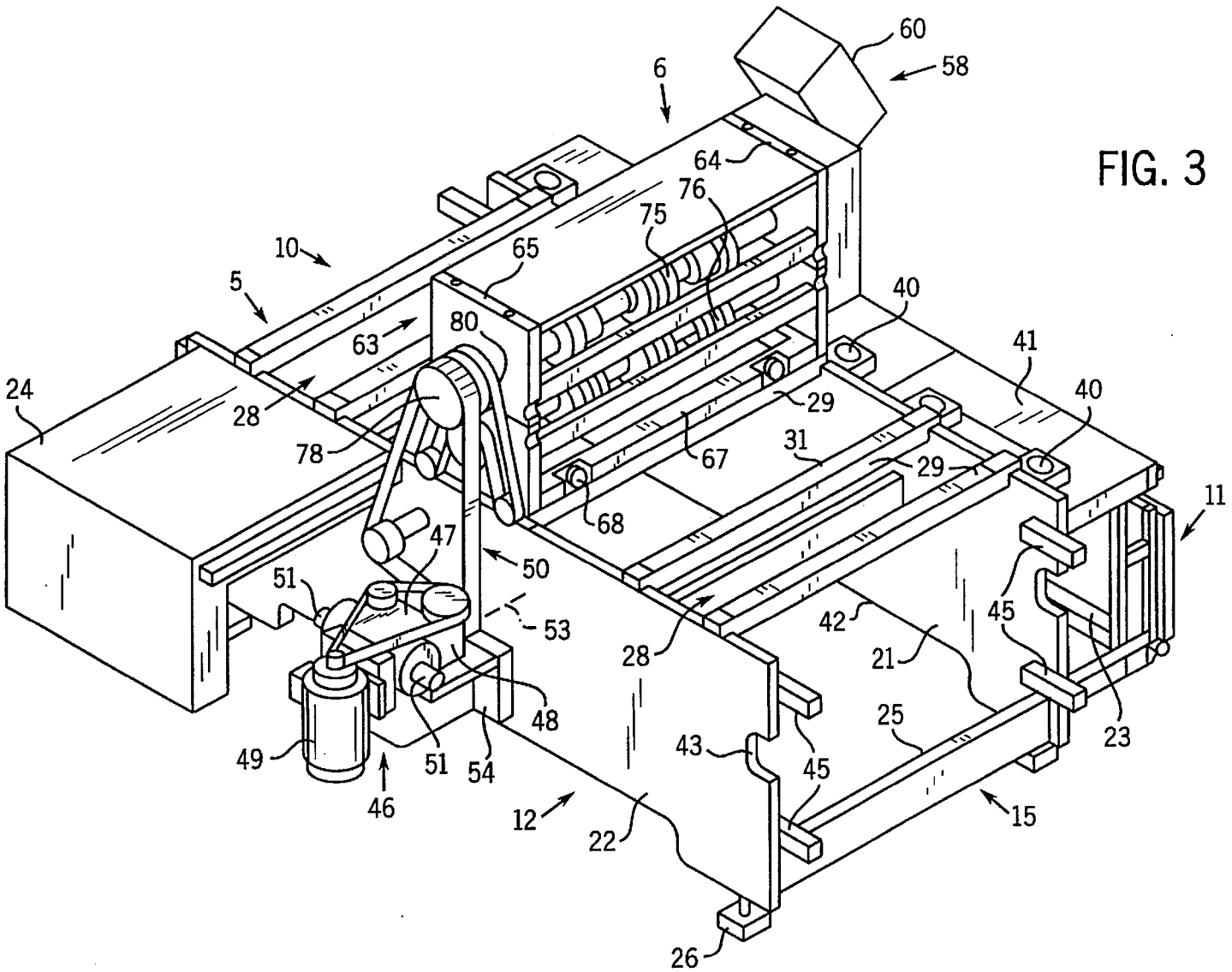
Figure 4:
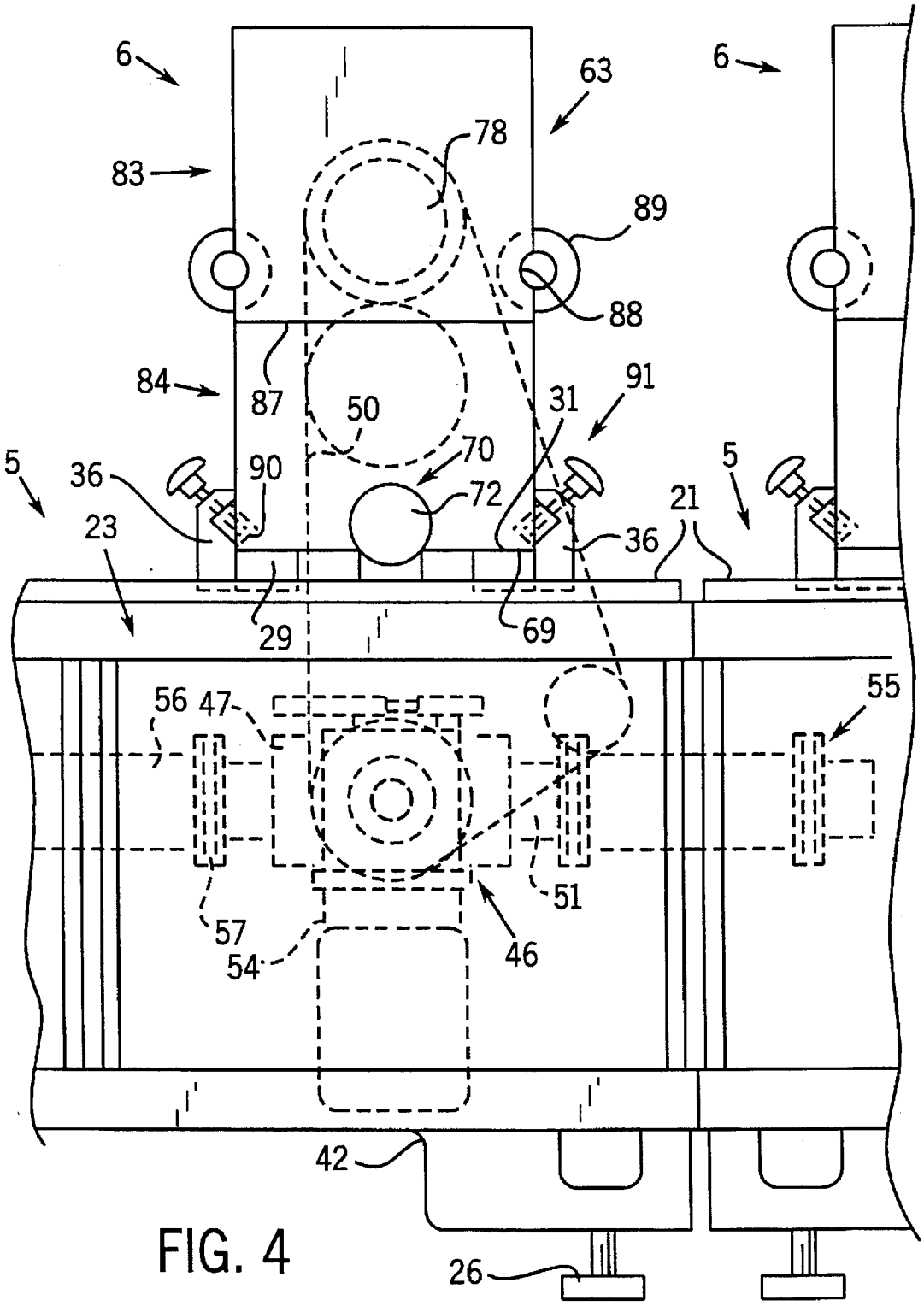

The apparatus 1 according to the invention has two superimposed frames or frame groups, namely a base frame 2 to be placed directly on a foundation floor and a randomly regroupable frame arrangement 3 carried by the frame 2 and to be positioned thereon through which the layer material, as a function of the intended working or processing, can be passed through the different working stations. The frames 2, 3 are connected to one another in an approximately horizontal separating plane 4, over which the frame 2 does not project upwards and the frame 3 does not project downwards, so that the dimensionally rigid frames 2, 3 are clearly separated from one another.

The frame 2 contains one or more elongated base units 5 lined up in its longitudinal direction and on which are arranged in spaced succession the frames 3 of the working unit 6. Each base unit 5 has three substantially identical or identically large, longitudinally succeeding base portions 7 for receiving three working units 6, which can assume essentially the same or layout surfaces differing according to a grid arrangement. The standing plane 8 roughly parallel to the separating plane 4 is below the latter on the underside of the frame 2, whereas the main conveying plane 9 roughly parallel thereto is positioned above it. In said conveying plane 9 the material is moved parallel to the longitudinal direction of the frames 2, 3 in a main conveying direction 10 between the front 11 and the back 12 of the frame, namely above the top 13 of the particular base unit 5 over and beyond the ends 14, 15 thereof.

The continuous web or layer material 16 can be supplied to the working unit 6 at one end of the frame 2 and/or between its ends from a storage means 17 or 18, such as a reel. It then continuously and successively passes through the working units 6, which are in each case used e.g. for tear-off checking, web edge regulating, web advance, groove formation, punching, further tear-off check, longitudinal folding, a further web advance, a further tear-off check, transverse cutting, waste detection and discharge, glue application and transverse folding.

Between the base units 5 or at the end of the frame 2 can also be provided at least one special unit 19, which is suitable for receiving more or less working units than the base units 5, with its working unit it forms a preassembled assembly and/or is easily movable as a whole, e.g. on castor wheels, the base frame of said unit 19 containing a corresponding number of base portions 7. At the end of the frame 2 or on the unit 19 can also be joined another end unit 20, e.g. to make available the layer units produced from the layer material in stacked, counted and/or bundled form for conveying away.

The bearing or supporting part of the base unit 5 essentially exclusively comprises two parallel, plate-like, identical, lateral or vertical walls 21, 22, which are joined together in dimensionally rigid manner by rod-like cross-members 25 and have standing feet projecting beyond the underside in order to be able to carry out in separate manner a height adjustment in each corner area. The front wall 21 carries on its front side for each base portion 7 an easily openable casing 23 and the rear wall 22 carries on its outside a casing 24. Adjacent casings 23 and 24 are essentially continuously connected to one another and extend approximately over the entire frame height. The casings 24 can also be individually opened or removed, whilst each wall 21, 22 passes in one piece over all the base sections 7.

The upper plate edges 27 of the walls 21, 22 located at the same height serve to form three reception positions or places 28 for the three working units 6 and for this purpose are exclusively interconnected by two parallel, spaced, identical, rod-like supports or carriers 29, which engage in easily detachable manner by their ends on the upper edges 27, are supported against longitudinal displacement on the insides of the walls 21, 22 and do not project over the remote outsides of the plates 21, 22. The supports 29 parallel to the planes 4, 8, 9 are at right angles to the conveying direction 10. Their planar tops form over approximately the entire length running or bearing surfaces 31 for the working unit 6 located in one plane 4. Said units can be moved at right angles to the conveying direction 10 or parallel to the planes 4, 8, 9 in or counter to the sliding in direction 30 on the bearing surfaces 31 or can be moved out from the latter, namely both on the front 11 and on the back 12, because the bearing surfaces 31 at least in the sliding in path form the highest surfaces of the frame 2 or are located in the separating plane 4. The tops of the casings 23, 24 are slightly lower than the latter. However, by means of a lifting mechanism the working unit 6 can be raised upwards in unhindered manner from the position 28 or engaged downwards.

Both ends of each support 29 are locked against the particular upper edge by bolts 32 countersunk in the running surface 31. In said upper edge 27 are provided in the longitudinal direction in a grid and successively, numerous reception bores for the bolts 32, so that the spacing between the support 29 can be modified in such a way that the position of the median plane located between the same is not modified. With each support 29 are associated two positioning members 33, 34 for the purpose of the working unit 6, which are spaced in the sliding in direction 30 and adjacent to the walls 21, 22 and are here trough-shaped depressions in the bearing surface 31, whilst transversely to the sliding in direction 30 and parallel to the plane 4 they are reciprocally displaced roughly by their width. On remote longitudinal sides of the supports 29 can be provided lateral guides 35 for the working unit 6, e.g. thin strips, which project upwards slightly above the bearing surface 31, have on their ends feed bevels and positively prevent a lateral sliding of the working unit 6 from the supports 29. Moreover, on the remote longitudinal sides of the supports 29 are provided manually or pneumatically operable clamping devices 36, which also serve as lateral guides with feed bevels and in order to secure the frame of the working unit 6 positively and non-positively against sliding movements in all directions both parallel and at right angles to the separating plane 4. The components 29, 33, 35 and 36 form a preassembled unit, which as a whole is adjustable with respect to the frame 2 in the described manner.

With each position 28 are separately associated all the connecting means necessary for the control and position adjustment of a working unit 6. The particular plate has in the vicinity of its top, namely in its upper edge or on a block fixed thereto, a coupling member 37, in which can be anchored in easily detachable manner a servocontrol with which the working unit 6 can be accurately moved continuously backwards and forwards parallel to the sliding in direction 30. On the outside of the front plate 21 and below the separating plane 4 is fixed a four-pole connecting plug 38 for the easily detachable reception of a counterplug of the working unit 6 and which is connected by means of a flexible line strand with corresponding functional units of the working unit 6. A corresponding plug 39 for a control fluid, e.g. compressed air can also be located within the associated casing 23 and can e.g. be fixed to the inside of its fold-up front wall. The working unit 6 also has a line strand with a corresponding counterplug for the plug 39. The line strands can be guided from above the separating plane 4 directly along the inside and/or the outside of the wall 21 into the casing 23 and to the connections 38, 39, e.g. through the top of the casing 23 or between the positioning members 40.

These positioning members 40 are used for the orientation of a mobile lifting means, such as the free ends of the support arms of a lift truck, with which the working unit 6 is so moved up to the base unit 5 and the associated supports 29, that it can be moved in the sliding in direction 30 by corresponding running and bearing surfaces of the lifting means in linear manner to the bearing surfaces 31 in the working position. Correspondingly and conversely removal of the working unit 6 takes place. The positioning members 40 are two upwardly open depressions for the engagement of countermembers of the lifting means and are positioned directly upstream of the associated ends of the bearing surfaces 31 in the vicinity of the remote sides of the supports 29. The positioning members 40 can be provided on the tops of blocks, which are fixed to the outside of the wall 21 or 22 and which pass through the upper table surface 41 of the associated casing 23. Between the positioning members 40 an opening is consequently formed in the table surface 41 through which the line strands can be led downwards. Corresponding openings 43 can also be provided in the walls 21, 22, e.g. on or between their ends.

The base spacing of the lower edges 42 of the walls 21, 22 creates further passage openings, which are also suitable for the passage of layer material, e.g. from the clamping device 18, which is supplied in the vicinity of a working station from below and transversely to the direction 10, then deflected upwards and then brought together with layer material already running in the direction 10. Whilst the reel storage means 17 is rotatable about an axis at right angles to the conveying direction 10, the reel storage means 18 is rotatable about an axis parallel to the direction 10 and is mounted on a frame, which is to be set up on the front or back 11, 12 of the frame 2.

The walls 21, 22 are also suitable for the easily detachable reception of random deflecting or guiding members, such as rotary guide rolls or rods, on which the layer material can undergo in the desired manner a change to its running direction, its position or its turning state. For example, on a single wall 21, 22 below the lower edge 42 can be fitted a guide member parallel to the conveying direction 10 and on which is guided the layer material supplied by the reel 18. On both walls 21, 22 and between the latter can be fitted a guide member at right angles or inclined to the conveying direction 10. For this purpose the walls 21, 22 have receptacles 44 in the form of through openings, in which can be inserted in braced manner bearings or trunnions of the guide members. Such receptacles 44 are also provided on the vertical terminal edges of the walls 21, 22 in the form of half-shells, in which can be radially inserted the guide member.

Each of the two mirror and/or centro-symmetrically constructed ends 14, 15 of the base unit 5 is so constructed for detachable connection with an aligned, similar base unit 5 or one of the units 19, 20 that said units can be separated or joined together transversely to the longitudinal direction 10 of the apparatus 1 and parallel to the planes 4, 8 and 9. For this purpose on the inside of each wall 21, 22 are to be fixed superimposed, rod-like connecting parts 45, whose fastening screws are accessible from the outside of the wall and which bridge the gap between interconnected walls 21, 22 roughly in the conveying direction 10. The connecting parts 45 are located below the separating plane 4 or the upper edges 27 and above the lower edges 42. Following the complete detachment of the connecting parts 45 from both base units 5, they are transversely displaceable against one another in unhindered manner or can be brought into their reciprocal working position, in which their corresponding walls 21, 22 are in each case equiplanar.

The base unit 5 also has means in order to provide for each position 28 a separate control and driving unit 46, which is appropriately exclusively located on the outside of the wall 22 and is substantially completely coverable by the associated casing 24. The driving unit can be a dynamically speed or rotation position-regulatable driving motor for the direct driving of the working roll and/or a gear arrangement movably mounted on the frame of the working unit 6 and which is driven by means of a vertical or main shaft 55 with a substantially constant speed and whose output is controllable in the described manner for the working unit 6. Through the dynamic control e.g. tools of the working unit 6 can be moved during a revolution with alternately faster and slower speed, e.g. so that during the working engagement can run synchronously with the layer material and between such working engagements can have a running speed differing therefrom.

The driving unit 46 arranged as a preassembled unit in easily detachable manner on the frame 2 and completely below the plane 4, 9 and carried exclusively with bottom freedom by the frame 2 has an angular gear 47, a superimposing gear 48 carried by the latter and a control drive 49 for the gear 48, which is located on the side of the gear 47 remote from the gear 48 and drives the latter by means of an easily removable toothed belt. The gear 47 has two equiaxially directed away and synchronously, equidirectionally rotating driving members 51, as well as a driven member 52 at right angles thereto and directed against the wall 22 and formed in each case by shaft journals. The axis of the driven member intersecting the axis of the driving members 51 serves as a turning axis 53 parallel to the plane 4, 8, 9 and at right angles to the longitudinal direction 10 for the entire driving unit 46, so that the two driving members 51 can be positionally interchanged and consequently their rotation directions can be reversed. For this purpose the driving unit 46 is pivotable with respect to its receptacle 54 fixed to the wall 22 if it is drive-connected by means of a drive 50 to the working unit 6. The maintenance-free connecting drive 50 is here a toothed belt drive, but can also be a change gear, whose gear wheels are mounted on a support pivotably positioned about the axis 53 on the wall 22. The drive 50 passing through the separating plane 4 is easily detachable in order to interrupt the drive connection for the assembly of the working unit 6.

The main shaft 55 parallel to the plane 4, 8, 9 and the direction 10 is mounted on the base unit 5 exclusively by means of the at least one driving unit 46, namely by engaging positively with respect to rotational movement plug connection with its driving members 51, so that the particular gear 47 forms an intermediate section of the main shaft 55. Between adjacent driving units 46 or the bearing points the main shaft 55 is appropriately formed by a one-piece shaft section 56, whose ends are detachably connected by means of couplings 57 engaging positively with respect to rotational movement with following shaft sections or the driving members 51. The coupling members of the coupling 57 are constructed in such a way that the shaft section 56 can be radially removed or inserted and each driving member 51 carries such a coupling member. As a function of the spacing of adjacent driving units 46, namely whether a unit 46 is or is not provided for each position 28, varyingly long, tubular shaft sections 56 are used, which are also covered within the casing 24. Therefore the main shaft 55 is provided in easily accessible manner spaced behind the outside of the wall 22 and its length can be varied at random.

At least one not shown drive motor can be located outside the casing 24 at the end of or spaced between the ends of the main shaft 55 and appropriately drives a wheel directly located on the driving member 51, which in the same way as the main shaft 55 is spaced below the plane 4, 9.

On the front the base unit 5 carries a hand or manual control 58 for the manual setting of working functions of the working unit 6, the manual control 58 being provided jointly for all the positions 28. The manual control 58 is so movable with a trolley 59 in longitudinal direction 10 approximately over the entire length of the base unit 5, that it or its control console 60 provided with control handles can be moved out of the sliding in path of each position 28 and can be moved in front of each working unit 6, so that during the setting the operator can immediately inspect the associated working unit 6 or its working zone. The control console 60 is above the table surface 41 or the plane 4, 9 and is always easily continuously rotatable about an upright axis at the upper end of a supporting column 61, which is displaceable in front of the front of the casing 23 on superimposed rails 62 using the trolley 59.

Each working unit 6 has at least one separate dimensionally rigid frame 63 to be placed as a preassembled unit on the frame 2 and which essentially comprises two plate-like walls 64, 65 and rod-like crossmembers 66, 67 connecting the latter. The vertical walls 64, 65 have roughly the same reciprocal spacing as the walls 21, 22, so that the remote wall outsides of the frames 2, 3 can be approximately located in a common plane. The bottom crossmember is constructed as a frame-like base 67, whose four, pairwise approximately parallel frame means at an angle to one another and connected in one piece to one another so surround a passage extending over the working width of the working unit 6 that through the same can be conveyed a correspondingly deflected portion of the layer material transversely to the plane 4, 8, 9. The substantially rectangular, plate-like, one-piece cast metal base 67 forms a running and supporting part for the displaceable supporting of the entire working unit 6 with respect to the frame 2 and also the frame base approximately parallel to the plane 4, 9, on which are fixed in supporting manner all the remaining frame parts 64, 65, 66. The lower ends of the frame walls 64, 65 are so fixed to the outer narrow sides of the base 67 by means of clamping bolts, that they engage over the base 67 approximately over the entire plate height.

Figure 5:
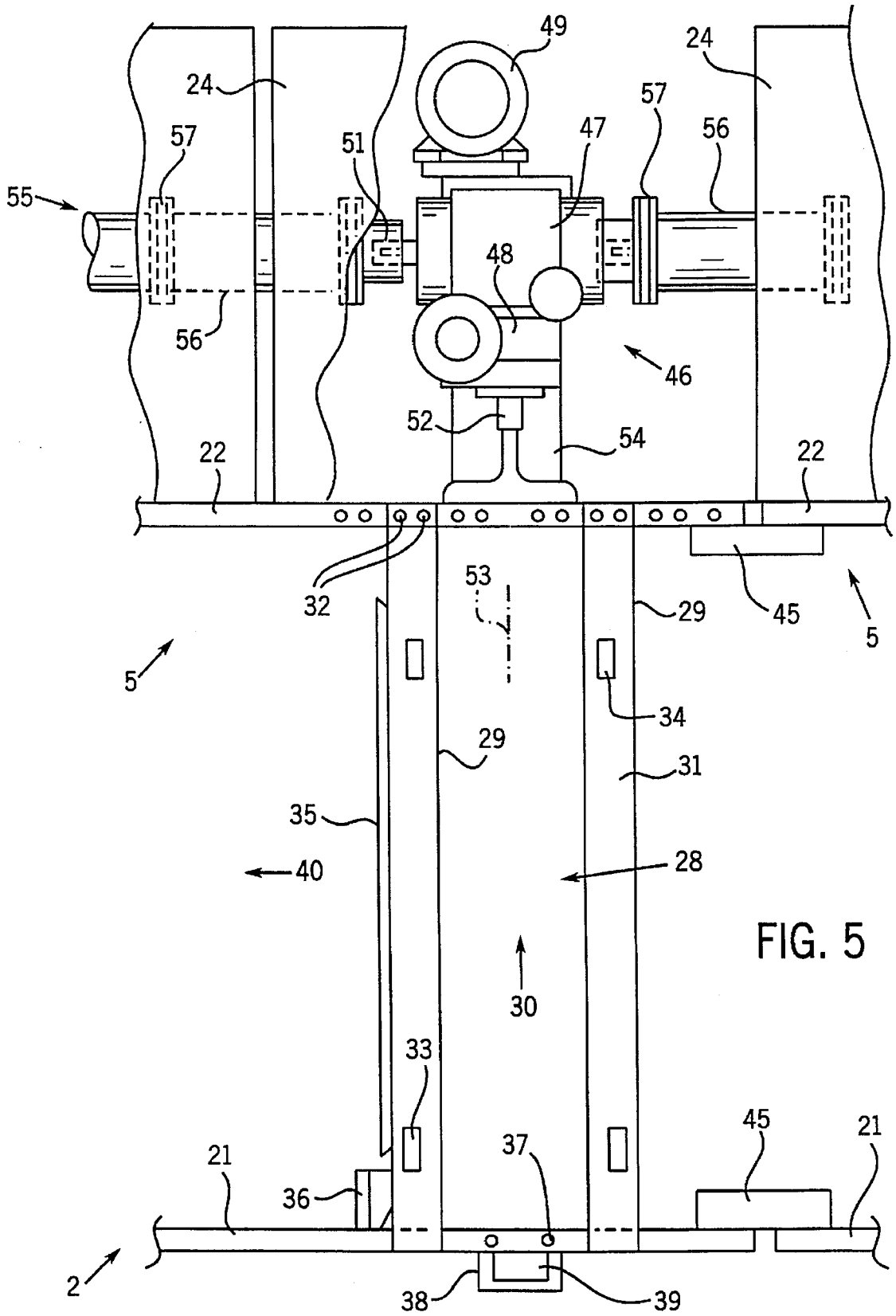
Figure 6:
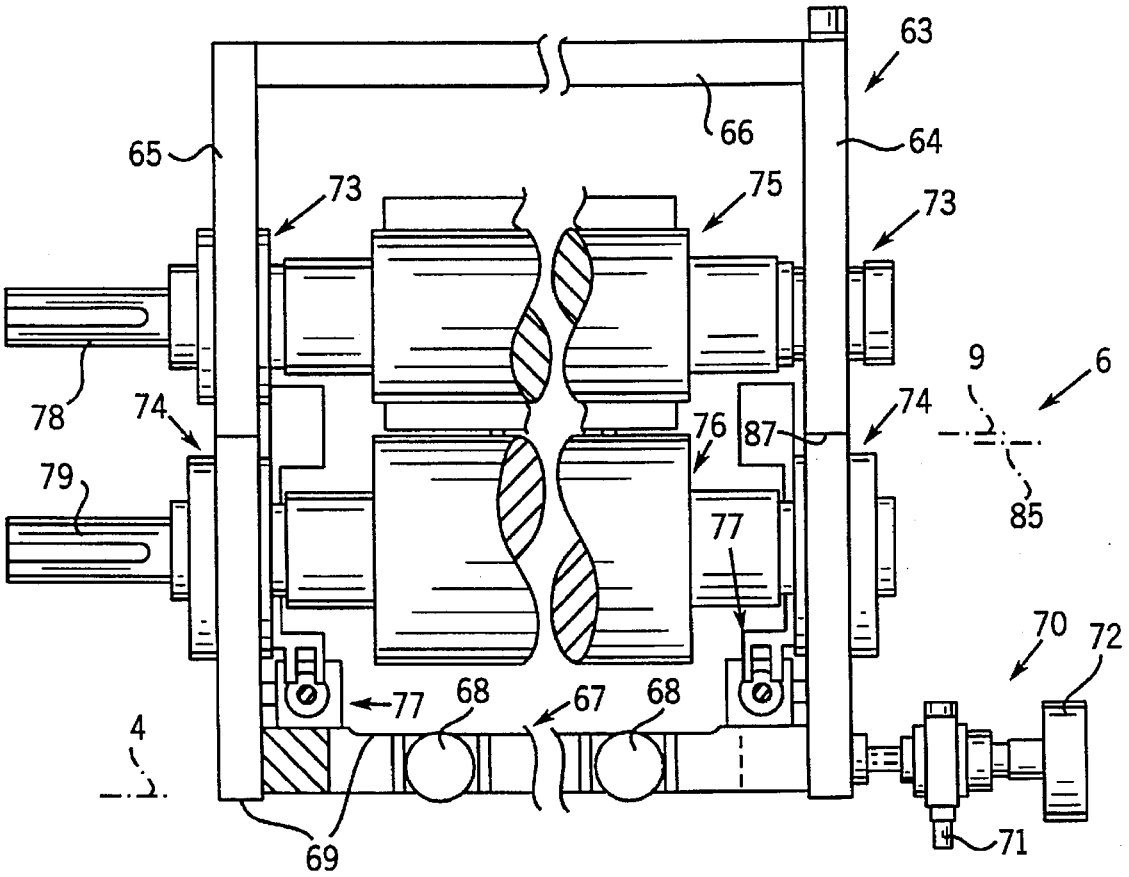

On the free longitudinal sides positioned tranversely thereto the longitudinal frame means of the base 67 have on their remote outsides pocket-like depressions, in which is mounted in rotary manner in each case one roll 68 in the form of a ball bearing about an axis at right angles to the sliding in direction 10 and parallel to the plane 4, as well as positionally rigid with respect to the frame 63. The arrangement of the rolls 68 corresponds to those of the positioning members 33, 34 and appropriately successive rolls are laterally reciprocally displaced in the described manner and axially facing or equiaxial rolls are so arranged that their axial spacing is approximately the same as that of the other roll pair. Thus, both supports 29 can be identically constructed in a construction somewhat modified compared with FIG. 5 or can be provided with an identical arrangement of positioning members 33, 34.

The components used for the roll arrangement are the same for all the rolls in that the laterally or axially displaced arrangement is only achieved in that a spacing member is positioned either on one or the other of the ends of the roll. The running faces of the rolls 68 can be formed directly by the outer circumferential surfaces of the outer rings of roller bearings. The running faces are in projection by only a few millimetres, e.g. max 5 to 10 mm over the underside of the frame 67, whereas the depth of the positioning members 33, 34 is slightly greater.

The underside of the base 67 forms further rolls 69, namely sliding and support faces, which can also be formed by the lower plate edges of the walls 64, 65 projecting slightly downwards over the base 67. These rolls 69 only extend over a small part of the longitudinal frame means parallel to the sliding in direction 30 or the ends thereof or the associated side walls 64, 65 into the vicinity of the rolls 68, so that a very precisely defined supporting action is obtained. If the rolls 68 simultaneously enter the positioning members 33, 34 bounded at both ends by ramp-like, rising base portions, the rolls 69 sink onto the supporting surfaces 31 and the rolls 68 assume a gap spacing from the supporting faces of the positioning members 33, 34, so that the entire working unit 6 is only slidably supported on the four rolls 69 located in its corner areas. The positioning members 33, 34 are so dimensioned that the rolls 68 with the frame 63 parallel to the sliding in direction 30 have a free movement clearance of approximately 10 mm and approximately 1 mm parallel to the direction 10.

For adjusting the frame 63 within said sliding in clearance, as well as the rolls 68 out of the locking depressions 33, 34 on the planar bearing surface 31 is provided a servodrive 70, which is accessible at all times from the front 11 or the outside of the front wall 64 for manual operation above the table surface 41 and approximately level with the base 67. The servodrive 70 has on a control member adjustable with a spindle with respect to the frame 63 and countersunk parallel to the sliding in direction 30 two coupling members 71 in the form of bolts, which can be so engaged in positive manner transversely to the plane 4 with their lower ends into the coupling members 37 that the control member is locked in clearance-free manner relative to the wall 21. If the axially secured spindle exclusively mounted in the wall 61 and not in the base 67 is now rotated with the handle 72, which is located on the control member side remote from the frame 63, the latter can be adjusted in and counter to the sliding in direction and consequently its transverse position on the layer material can be adjusted.

However, the unit 6 can also be adjusted to such an extent that its rolls 68 run against the rising base ramp of the positioning members 33, 34 and then roll counter to the weight force of the working unit 6 up to the bearing surfaces 31 and then without any translation the working unit 6 can be manually easily moved on the supports 29. As the rolls 68 at one end of the working unit 6 are displaced relative to the rolls 68 at the other end, like the positioning members 33, 34, the rolls of one end move laterally past the positioning members of the other end in unimpeded manner and are not again locked therein through the weight force of the working unit 6.

Before the working unit 6 is adjusted in the described manner, appropriately the clamping devices 36 are tightened slightly, so that it is difficult to move the working unit 6. For this purpose the clamping devices 36 have on a block fixed to the associated support 29 in each case a setscrew manually adjustable in inclined manner to the plane 4 and whose end face can be engaged downwards against a correspondingly inclined counterface or locking face 90 of the frame 63 or the base 67. These locking or bearing faces 90 are located in the vicinity of the rolls 69 and are formed by bottom faces of the depressions, so that over said positioning path they form a sliding face for the setscrew, but at their ends pass into stop faces, which then prevent a further displacement of the working unit 6 if the particular setscrew is not completely turned out of the depression. The clamping arrangement 36 simultaneously forms positioning means 91 for adjusting the working unit 6 parallel to the plane 4, 9 and to the direction 10 and in the vicinity of each wall 64, 65 a separate adjustment is possible, so that the working unit can also be rotated about a positioning axis located roughly in its centre and at right angles to the plane 4, 9. After adjusting the working unit 6 the clamping devices 36 are completely tightened in such a way that the unit 6 is secured in positionally rigid manner relative to the frame 2.

The walls 64, 65 in each case have aligned receptacles for bearings 73, 74 of approximately axially parallel working members or tools 75, 76. Here there are rotary rollers with circumferentially provided tools, e.g. an upper grooving tool 75 and a lower, smooth-surfaced countertool 76, between whose circumferential surfaces is bounded a through gap for the layer material located in the plane 9 and which in said plane runs from one side between the walls 64, 65 into the frame 63 and leaves the same on the other side. The working members 65, 66 have driving members 78, 79 formed by shaft journals rigidly connected internally thereto positioned on the outside of the rear wall 65 and which are to be connected so as to engage positively with respect to rotational movement to detachably mounted rolls, such as pulleys, gear wheels, etc.

The roll of the tool 75 is driven directly by means of the connecting drives 50 and a further roll to be placed on the driving member 78 drives by means of a further intermediate drive 60 located on the outside of the wall 65 the tool 76. This intermediate drive 80 can also be constructed as a simple belt drive and for the belt further deflections can be provided on the outside of the wall 65 in order to increase the looping angle of the associated roll. Also for the belt of the drive 50 further deflections can be provided on the outside of the wall 65, in order to reverse the rotation direction of the driving member 78 with respect to that of the driven member 52. Any idler pulleys for the drive 50 are appropriately provided on the base unit 5. Thus, apart from the easily detachable connecting drive 80, the working unit 6 has no further gear stages for driving the tools 75, 76.

Figure 7:
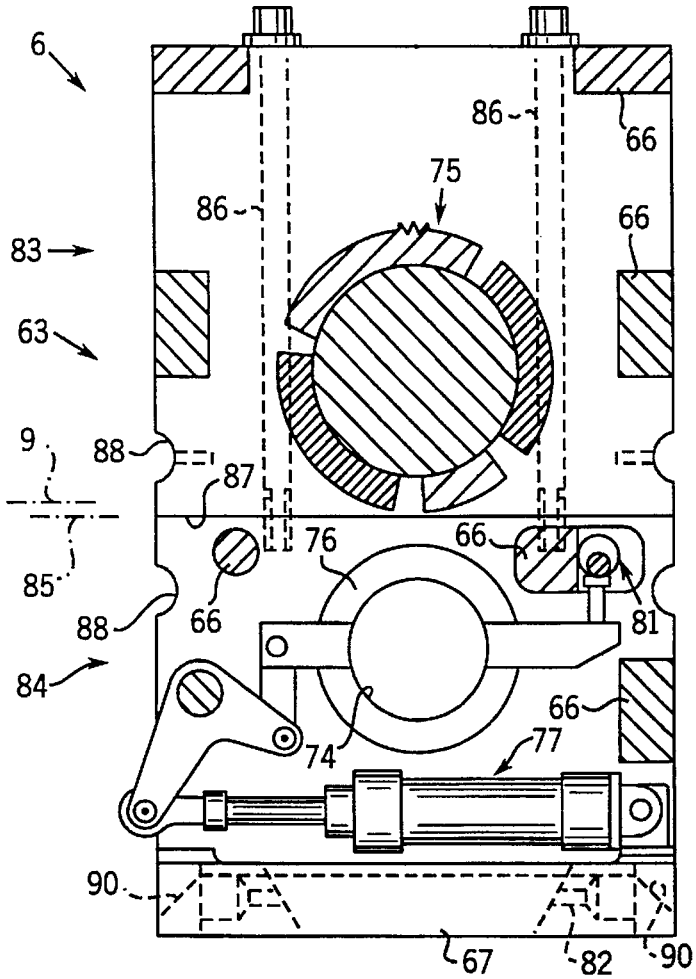
Figure 8:
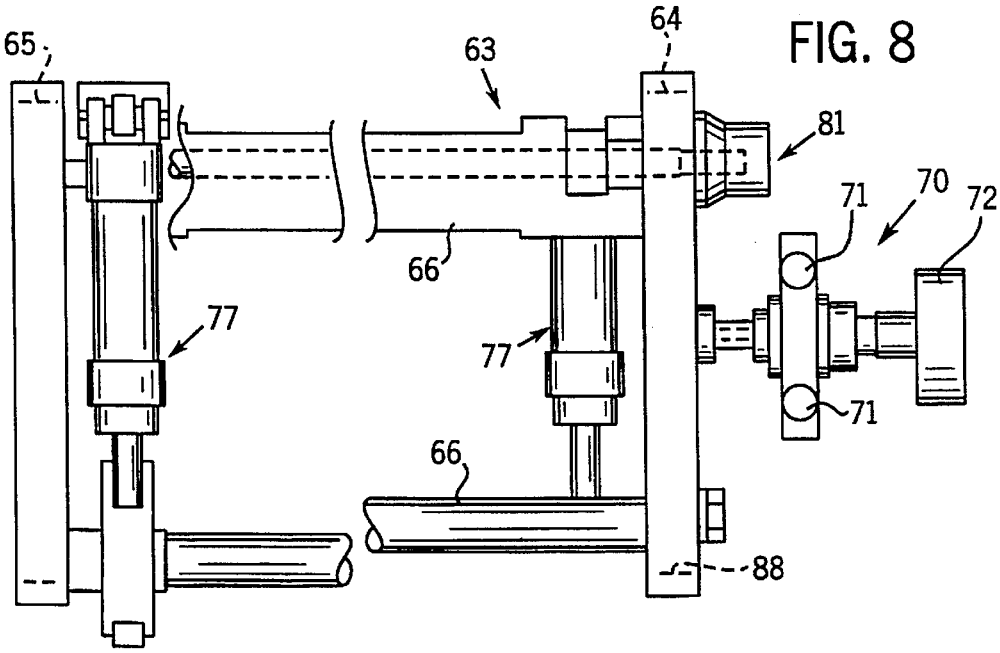

At least a servodrive 77 for setting the reciprocal spacing of the tools 75, 76 or for deactivating the tools by an adequate widening of the working gap is provided completely on the frame 63 above the base 67 between the walls 64, 65. Directly above the base 67, said servodrive 77 has at least one horizontally positioned working cylinder, which by means of a toggle lever adjusts an eccentric receiving the mounting of the tool 76 with respect to the frame 63 and consequently raises the tool 76, not shown in FIG. 7, downwards from the working plane 9. The feeding in to the working plane 9 is limited by a stop, which is in turn manually adjustable by a servodrive 81. The associated handle is located alongside the handle 72 on the front of the frame 63 or the wall 64 in easily accessible manner and by means of a servoshaft acts on a stop eccentric, which is rotatably mounted in a cutout of a crossmember 66. The base 67 can have connecting couplings 62 in the form of through bores of their longitudinal frames, on which are connectable on the one hand a supply line for a fluid control or a control valve and on the other a connecting line to the working cylinder. This gives very space-saving connection possibilities and the control line can be connected in the described manner to the connection 39.

For all the working units having roughly the same extension in the direction 10 the base 67 can have an identical construction for interchangeability purposes. However, at least one other base size is appropriate and preferably a base in the direction 10 has an extension of approximately 300 mm and a base of approximately 450 mm.

The frame 63 comprises two or more easily detachable partial frames 83, 84, whereof the particular parts of both walls 64, 65 and at least two of said partial walls contain dimensionally rigidly connected crossbars 66. The frame 83, 84 contains the complete mounting 73 or 74 for at least one tool 75 or 76, so that it can be installed and removed as a preassembled unit with said components. Here the frame 83 contains the tool 75 with the associated driving member 78 and the partial frame 84 contains the tool 76 with the associated driving member 79, as well as the servodrives 77, 81. One, namely the bottom partial frame 84 forms a preassembled unit with the base 67 and serves as a base or sliding in frame, which alone carries the or the other frames 83 and can be assembled therewith in the described manner on the frame 2. In the case of a base frame 84 installed in this way the easily detachable partial frame 83 can be removed upwards or mounted in the opposite direction and/or parallel to the directions 10, 30.

For this purpose the walls 64, 65 are divided in a separating plane 85 roughly parallel to the plane 4, 8, 9 and which is appropriately a few millimetres below the plane 9, so that the lower plate edges 87 of the partial walls of the frame 83 not only serve as individual, planar and congruent connecting faces for the upper plate edges of the partial walls of the frame 84, but also as standing surfaces, on which the frame 83 can be so inherently stably mounted on a planar bearing surface and displaced in sliding manner, that the tool 65 displaced upwards with respect to the standing surface 87 is not in any position in contact with the bearing or table surface and can consequently not be damaged. The partial frames 83, 84 are braced against one another with bolts 86, which appropriately pass through the connecting faces 87 or the complete partial wall of the frame 83 up to its upper plate edge and therefore are easily accessible from above.

It is also possible between the reciprocally supported wall edge faces 87 to provide a rail-like intermediate profile, e.g. a H-profile or section, whose two legs in centred manner engage round both wall parts on the inside and outside and serves as an interchangeable spacing member and is traversed by the bolts 86. If from a multilayer web at least one layer is not to be worked by the tools 75, 76 in the vicinity of the working unit 6, then between the underside of the base 67 and the supporting surfaces 31 can be introduced further working unit, which is constructed on the underside like the base 67 and on the top side like the supporting surfaces 31. This working unit provided as a spacing member has between the planes 4, 9 a passage for the layer web not to be worked and which in the direction 10 in front of the working unit 6 is moved away from the layer web to be worked through the passage and following the unit 6 can be guided back to the working layer web. The layer web not to be worked can also be guided round the working gap of the working unit 6 below the plane 4, 9 or within the frame 2.

The frames 663, 83, 84 or their plates also have receptacles 88 for at least one guidance member 89 of the type described relative to the base unit 5. The shell-like or approximately semicircular reception members 88 countersunk in the front and rear vertical plate edges of the walls 64, 65 are e.g. used for the centred insertion of the spindle of a roller-like guidance member 89, which surrounds in rotary manner the said spindle and with its guidance circumference extends close to the plane 9, the reception members 88 being provided on either side of the plane 9. In the bottom face of the reception members 88 is provided a taphole, so that with a bolt traversing the spindle a bracing against the bottom surface is possible without a bearing countershell.

In a separate switch cabinet installed remotely from the frame 2, the control device 92 has a main or master control 93, a main operating control 94 on the operating side 11 of the apparatus 1 for manual data input purposes and for each base unit 5 a working control 95, which can be located in the casing 23 and belongs to the preassembled base unit 5. Said controls 93 to 95 are successively switched or connected in closed circuit by means of a four-pole signal line 97.

The working controls 95 of all the base units 5 are identical as regards function and installation and are line-connected to all the plugs 38 of the associated base unit 5. All the signals of sensors and operating means of the associated working station pass via the plugs 38. The base unit 5 has for the layer web a tear-off monitor, to which can be connected sensors, such as light probes, light barriers, disconnectors, initiators, ultrasonic sensors, etc. The base unit 5 also contains the independently operating, memory programmable control 95 and the voltage distribution for the electric power to be supplied to the particular working station. The corresponding distributor is located in the casing 23 and contains the control 95. The leads from the control 93 to the particular distributor has a four-pole, easily detachable plug coupling, which is provided on the driving side 12 or the base unit 5.

The control 95 is attached to the control network union as a so-called slave control and processes all the informations to the operating means or from the sensors, which are located on the base unit 5. Corresponding memory programmable controls 96 are also provided for the main control 93 and operating control 94. The controls 95, 96 are interconnected by means of a control bus, so that they can be individually switched on and off and therefore coupled and decoupled with respect to the particular base unit 5. The two-wire connection of the data bus system between the memory programmable controls is provided both on the incoming and outgoing side of the particular control 95 with a multipole, easily detachable plug coupling. For each driving unit 46 there is also such a plug coupling and the coupling member associated with the base unit 5 is fixed to the latter.

The hand or manual control 58 belonging to the control device 92 is used for the manual control of the main drive, the register drive 49, the pneumatic supply and the stopping or operational disconnection of the complete apparatus in emergencies.

The operating control 94 is used for the manual control of all the basic functions of the overall apparatus 1, e.g. the control voltage, main drive, emergency cutout, secondary units, such as blower or hydraulic units, point control, etc.

Two of the working units 6 between which at least one further working unit is provided, are used for the driven conveying advance of the layer material, which between said drawing in or advance units and through the latter undergoes a predetermined maximum web tension in its longitudinal direction. The two advance units operate as a function of one another. To be able to regulate the web tension, the advance unit following in the direction 10 operates with a correction value, which can be inputted by means of the manual control 58 at the necessary layer web 16 and acts on the associated register drive 48, 49. If the layer material 16 has signal or pressure marks successively arranged in a given grid and if means are provided on the unit 5 or 6 for the detection thereof, then the web tension can also be regulated in such a way that a possibly inadequate spacing between successive marks is increased by a longitudinal extension of the layer web or an excessive spacing is correspondingly corrected.

With the first advance unit in the direction 10 by means of three signal generators the desired position of the signal marks with respect to the rotation position of the main drive 55 is regulated. The signal generators are a signal mark reader, an increment generator running as a function of the main shaft 55 and a tachomachine for delivering an analog signal. Following the position divergence of the signal mark with respect to the predetermined position of the main shaft 55, the advance unit is given a speed change by the superimposing gear 48.

For working-engaging working units in successively positioned transverse zones of the layer material, such as cross-cutters, the corresponding tool 75 is set up in register, namely on the format to be produced or its relative position with respect to the signal mark. The reader, e.g. a glass fibre optics, which operates in the direction 10 upstream of the following or between the advance units, detects the signal mark, which on setting up the layer material with respect to the cross-cutter blade is brought into the desired position. If the tool cylinder has the same circumference development extension as the format to be produced, then an increment generator can be placed directly on the cutter shaft and operates corresponding to the previously described increment generator.

The controls 95, 96 are distributed as a network over the entire machine and the control 93 contains the so-called master control 96, which is essentially supplied with all the data. Each of the independently operating controls 95 can be easily removed or the entire network can at any time be extended by a participant 5, 6 containing such a control 95.

We claim:

1. An apparatus for working layer material (16) having properties of substrate materials, comprising:

at least one working unit (6) for working the layer material (16), said working unit (6) determining a conveying direction (10) and a general conveying plane (9) for the layer material (16), said working unit (6) including connecting means for operationally and directly connecting said working unit (6) with an apparatus base (2) in an operating position, in said operating position said working unit (6) defining an operational working state, a working station and a working zone, said working unit (6) including at least one base frame unit (84) including said connecting means, wherein said base frame unit (84) is constructed as a subassembly substantially ready for operation for conveying said layer material when assembled with the apparatus base (2), said base frame unit (84) having at least one assembly runner (68) for guiding said base frame unit (84) on the apparatus base (2) during insertion of said base frame unit (84) in a substantially horizontal insertion direction (30) along an insertion path via an insertion motion, said insertion direction (30) being oriented transverse to said conveying direction (10), wherein a separating plane (4) is defined which substantially separates said working unit (6) from a top of the apparatus base (2), and wherein in said operating position said working unit (6) extends substantially only above said separating plane (4) and wherein no portion of the apparatus base (2) extends above said separating plane (4).

2. The apparatus according to claim 1, wherein said working unit (6) has a dimensionally rigid bearing frame (63) including lateral frame members (64, 65) for conveying the layer material (16) between said frame members (64, 65) of said insertion unit (6), said bearing frame including an underframe (67) rigidly connected to said frame members (64, 65), said underframe (67) including support faces (69) defining a standing plane (4) in the vicinity of and separate from said at least one assembly runner (68) for supporting said working unit (6) on the apparatus base (2) in said operating position, said support faces (69) being sliding faces for slidingly adjusting said working unit (6) with respect to the apparatus base (2) in a direction parallel to said conveying direction (10).

3. The apparatus according to claim 1, wherein said working unit (6) has at least one assembly runner (68) for positively engaging a counter member (33, 34) of the apparatus base (2) to limit motion of the working unit (6) parallel to said conveying direction (10), means being provided for automatically positively engaging in the counter member (33, 34) under the weight of the working unit (6) only at an end of said insertion motion and upon arriving at said operating position, in said operating position said at least one assembly runner (68) providing a motion clearance for positionally adjusting said working unit (6) with respect to the apparatus base (2) in an adjusting direction oriented substantially parallel to said conveying direction (10).

4. The apparatus according to claim 3, wherein said working unit (6) further comprises tensioning means (36) including actuating means for positionally positively securing said working unit (6) against the apparatus base (2) without motion play, and wherein when said working unit (6) is in said working state said actuating means is freely accessible for manually bracing said working unit (6) against the apparatus base (2), said tensioning means (36) being releasable for displacing and positionally adjusting said working unit (6) against the apparatus base (2) in said adjusting direction and about an adjusting axis oriented perpendicular to said separating plane (4).

5. The apparatus according to claim 4, wherein said tensioning means (36) include drive means (70, 91) for positionally adjusting said insertion unit (6) with respect to the apparatus base (2).

6. The apparatus according to claim 1, wherein drive means (70, 91) are provided for positionally adjusting said insertion unit (6) when in said operating position, said drive means (70, 91) being provided for adjusting substantially with respect to at least one of a direction parallel to said inserting direction (30), a direction parallel to said conveying direction (10) and a direction around an adjusting axis oriented transverse to said inserting direction and said conveying direction (10).

7. The apparatus according to claim 1, wherein said working unit (6) includes at least one working tool (75, 76) for engaging the material (16), said working tool (75, 76) being operationally movably mounted in bearings (73, 74), said working unit (6) including first and second frame units (83, 84) easily detachable from one another when in said operating position, said first frame unit (83) providing a base frame unit (83), said first frame unit (83) autonomously bearing said working tool (75, 76), said first frame unit (83) autonomously including positioning means (77, 81) for positionally adjusting said at least one working tool (75, 76) with respect to said second frame unit (84) in a direction transverse to said conveying direction (10), said insertion direction, and a general conveying plane (9) defined by said first frame unit (83), each of said frame units (83, 84) including frame members rigidly interconnected with cross bars (66) to thereby provide a pre-assembled assembly unit, said frame members of said first frame unit (83) including bottom faces (87) located below said general conveying plane.

8. The apparatus according to claim 7, wherein said frame members each have at least one lateral frame wall (64, 65) located laterally outside the layer material (16), said frame units (83, 84) being rigidly interconnected only laterally outside the layer material (16) and in the vicinity of at least one of said frame walls (64, 65), with respect to said general conveying direction (10), said at least one frame wall (64, 65) including frontal and rear wall edges, at least one reception member (88) being provided on said wall edges for mounting at least one guide member (89) for guiding the layer material (16).

9. The apparatus according to claim 1, wherein said working unit (6) includes at least one working tool (75, 76) for workingly engaging the layer material, laterally outside of the layer material (16) said working unit including a rear outside, on said rear outside said working unit (6) bearing at least one input drive member (78, 79), means being provided for easily detachably and drivingly connecting said input drive member (78, 79) to an output drive member (52) of a driving unit (46) separate from said working unit (6), said drive connecting means including a drive belt (50) traversing said separating plane (4).

10. The apparatus according to claim 1, wherein said apparatus base (2) has a plurality of insertion receptacles (28), said insertion receptacles (28) being arranged in a sequence parallel to said conveying direction (10), each one of said insertion receptacles (28) providing an individual receptacle (28) for autonomously mounting an individual corresponding working unit (6) when in said operating position, wherein said apparatus base (2) includes at least one substantially autonomously operable and supportable first base unit (5) providing at least one of said insertion receptacles (28), at least one second base unit (5) including at least one of said individual receptacles (28), and wherein connecting means (45) are provided for rigidly but detachably interconnecting said first base unit (5) with said second base unit (5), and wherein means are provided for elongating and shortening a working path of said apparatus by adding and removing said second base unit (5), said second base unit (5) being individually connectable to and removable from said apparatus base (2), each working unit (6) being individually connectable to and removable from said apparatus base (2) and said base unit (5), each base unit (5) and each working unit defining an operating module, each first base unit (5) and each second base unit (5) supporting a corresponding load, wherein each load is individually and separately supportable by each respective base unit (5).

11. The apparatus according to claim 10, wherein at least one of said first and second base units (5) comprises a pre-assembled unit including a mounting receptacle (24, 54) for a driving shaft (55) provided for driving each of said working units (6) when mounted on said at least one insertion receptacle (28), said driving shaft (55) being variable in a shaft length extension and assembled from longitudinally juxtaposed shaft sections (56), said shaft sections (56) having coupling members (57) for radially mounting and disassembling said shaft sections individually, said driving shaft (55) being provided for drivingly interconnecting said first base unit (5) and said second base unit (5).

12. The apparatus according to claim 10, wherein at least one of said first and second base units (5) has a separate holding receptacle (54) for said insertion receptacles (28), said holding receptacle (54) being provided for mounting a drive unit (46) for operating said at least one working unit (6).

13. The apparatus according to claim 10, wherein for each of said individual receptacles (28) provided on at least one of said first and second base units (5), wherein said base unit (5) includes a separate and individual drive unit (46) including at least one driving input (51) for a drive motor and a driving output (52) for an individual one of said working units (6), said drive unit (46) including positioning means (48) between said input (51) and said output (52) for controlling at least one of a driving direction of said output (52), and a relative positioning between said input (51) and said output (52).

14. The apparatus according to claim 13, wherein said driving output (52) includes a pulley for easily detachably receiving a driving belt (50) driving said working unit (6) and traversing said separating plane (4).

15. The apparatus according to claim 10, wherein laterally outside the layer material at least one of said base unit and said working unit (5, 6) provides at least one frame member (64, 65 or 21, 22) positionally stable when in said operating position, at least one of said frame member providing at least one receptacle (88, 44, 42, 43) for separably receiving at least one of at least one guidance member (89) for guiding the layer material (16), a guide rod oriented fixedly with respect to said conveying direction (10), a deflection member for deflecting the layer material (16) past said working zone and at least one control and supply line for operating said working unit (6), said at least one base unit (5) being addable to and removable from said apparatus base (2) in a mounting motion oriented substantially transverse to said conveying direction (10) and parallel to said insertion direction (30).

16. The apparatus according to claim 10, wherein said apparatus further comprises a common manual control unit (58) for exclusive control of at least two insertion receptacles (28) of an individual said base unit (5), said control unit (58) being provided for controlling all said working units (6) when mounted on said at least two insertion receptacles (28), said control unit (58) including a pre-selecting handle for manually pre-selecting each particular one of said working units (6) for alternately controlling operating functions of said particular working unit (6), said control unit (58) being located in front of said apparatus base (2) and being continuously displaceable with respect to said apparatus base (2) in a direction parallel to said conveying direction (10), said control unit (58) being displaceably mounted on said base unit (5).

17. The apparatus according to claim 10, wherein said apparatus further comprises a control unit (58) including a manually operable control console (60) freely movable along said base unit (5) by manual force, said base unit defining a top side in the vicinity of said at least one insertion receptacle, said control console (60) being at least partly located above said top side, said base unit (5) defining length sides including a front side, a rear side and a drive side, said control console (60) being at least partly located spacedly in front of at least one of said length sides remote from said drive side, for giving way while inserting and removing at least one of said working unit (6) past said control console (60), said control console (60) being movable laterally outside said insertion unit when seen in said inserting direction said control console (60) being located on top of a supporting column (61).

18. The apparatus according to claim 1, wherein said apparatus base (2) rigidly holds at least one insertion receptacle (28) for autonomously mounting only one of said at least one working unit (6) on top of said apparatus base (2) when said working unit (6) is in said operating position, wherein at least a lateral reception member (29) of said insertion receptacle includes a pre-assembled reception unit including an insertion guide for guiding said at least one assembly runner (68) during insertion of said working unit (6) to achieve said operating position, further including positioning members (33, 34) for centering said working unit (6) when in said operating position, and further including clamping members (36) for clamping said working unit (6) against said apparatus base (2) when said working unit (6) is in said operating position, said reception unit being separably fixed to said apparatus base (2) and rigidly connecting side portions (21, 22) of said apparatus base (2), said working unit (6) being separable from said reception unit when said reception unit is rigidly connected with said apparatus base (2).

19. The apparatus according to claim 1, wherein said apparatus further comprises a plurality of working units (6), and a main control means (92) for collectively controlling substantially all said working units (6), said main control means (92) including a computer-aided control device connected to external control lines, and each of said working units (6) having connectors (38, 39) for separably and operationally connecting said control lines at least one of said connectors (38, 39) being attached to said apparatus base (2) below said separating plane (4).

20. The apparatus according to claim 19, wherein said main control means (92) includes a master control (96) for monitoring input data and controlling output data, a main control station (94) for accepting manual inputs, memory programmable controlling units (95) for controlling each of said working units (6), and a network including a data bus that connects to the working units (6) and to the memory programmable control units (95, 96) for a substantially continuous ring mode of communication of data, said data bus being provided for receiving and delivering substantially all control and state determination signals at said memory programmable control units (95, 96) of substantially all of said working units (6), at said master control (96) and at said main control station (94) while operating in said ring mode of communication of data.

21. The apparatus according to claim 19, wherein said main control means (92) include a manually operable main control station (94) incorporating a register control, at least one of said working units (6) including at least one working tool (75, 76) for operably working on the layer material (16) in a driven working motion, said register control being provided for reciprocally orienting the layer material (16) and said working motion via a reciprocal control motion, said main control means (92) being provided for longitudinally continuously tensioning the layer material (16) between locations upstream and downstream of said at least one working unit (6).

22. An apparatus for working layer material (16) having properties of substrate materials, comprising:

at least one working unit (6) of working the layer material 16), said working unit (6) determining a conveying direction (10) and a general conveying plane (9) for the layer material (16), said working unit (6) including connecting means for operationally and directly connecting said working unit (6) with a apparatus base (2) in an operating position, in said operating position said working unit (6) defining an operational working state, a working station and a working zone, said working unit (6) including at least, one base frame unit (84)

including said connecting means, wherein said base frame unit (84) is constructed as a subassembly substantially ready for operation for conveying said layer material when assembled with the apparatus base (2), said base frame unit (84) having at least one assembly runner (68) for guiding said base frame unit (84) on the apparatus base (2) during insertion of said base frame unit (84) in a substantially horizontal insertion direction (30) along an insertion path via an insertion motion, said insertion direction (30) being oriented transverse to said conveying direction (10), wherein a separating plane (4) is defined which substantially separates said working unit (6) from a top of the apparatus base (2), wherein in said operating position said working unit (6) extends substantially only above said separating plane (4) and the apparatus base (2) wherein said working unit (6) includes a bearing frame (63) with a trolley bearing for guiding the working unit (6) with respect to the apparatus base (2) during insertion of the working unit (6), said trolley bearing having at least one assembly runner (68) including at least one support roll, said at least one assembly runner (68) including at least three individual runners (68) for substantially stably supporting said working unit (6), said bearing frame (63) including an underframe (67) traversed by a passage for conveying the layer material (16) through said underframe (67) in a direction transverse to said general conveying plane (9) oriented substantially horizontally.

23. An apparatus for working layer material (16) having properties of subtrate materials, comprising:

at least one working unit (6) for working the layer material (16), said working unit (6) determining a conveying direction (10) and a general conveying plane (9) for the layer material (16), said working unit (6) including connecting means for operationally and directly connecting said working unit (6) with an apparatus base (2) in an operating position, in said operating position said working unit (6) defining an operational working state, a working station and a working zone, said working unit (6) including at least one base frame unit (84) including said connecting means, wherein said base frame unit (84) is constructed as subassembly subtantially ready for operation for conveying said layer material when assembled with the apparatus base (2), said base frame unit (84) having at least one assembly runner (68) for guiding said base frame unit (84) on the apparatus base (2) during insertion of said base frame unit (84) in a substantially horizontal insertion direction (30) along an insertion path via an insertion motion, said insertion direction (30) being oriented transverse to said conveying direction (10), wherein a separating plane (4) is defined which substantially separates said working unit (6) from a top of the apparatus base (2), wherein in said operating position said working unit (6) extends substantially only above said separating plane (4) and the apparatus base (2):

wherein said working unit (6) has at least one assembly runner (68) for positively engaging a counter member (33, 34) of the apparatus base (2) to limit motion of the working unit (6) parallel to said conveying direction (10), means being provided for automatically positively engaging in the counter member (33, 34) under the weight of the working unit (6) only at an end of said insertion motion and upon arriving at said operating position, in said operating position said at least one centering member providing a motion clearance for positionally adjusting said working unit (6) with respect to the apparatus base (2) in an adjusting direction oriented substantially parallel to said conveying direction (10); and wherein said working unit (6) has a plurality of said assembly runners (68) including a frontal centering assembly runner and a rear centering assembly runner on each lateral side of said working unit (6), said frontal centering assembly runner (68) being laterally offset with respect to said rear centering member in a direction transverse to said insert direction (30), wherein the counter member (33) of the apparatus base (2) is provided for engaging said rear centering assembly runner (68) without engaging said front centering assembly runner (68), in said operating position said centering assembly runner (68) having limited motion clearance with respect to the apparatus base (2) to permit adjusting motions of said working unit (6) parallel to said insertion direction (30).

24. An apparatus for working layer material (16) having properties of substrate materials, comprising:

at least one working unit (6) for working the layer material (16), said working unit (6) determining a conveying direction (10) and a general conveying plane (9) for the layer material (16), said working unit (6) including connecting means for operationally and directly connecting said working unit (6) with an apparatus base (2) in an operating position, in said operating position said working unit (6) defining an operational working state, a working station and a working zone, said working unit (6) including at least one base frame unit (84) including said connecting means, wherein said base frame unit (84) is constructed as a subassembly substantially ready for operation for conveying said layer material when assembled with the apparatus base (2), said base frame unit (84) having at least one assembly runner (68) for guiding said base frame unit (84) on the apparatus base (2) during insertion of said base frame unit (84) in a substantially horizontal insertion direction (30) along an insertion path via an insertion motion, said insertion direction (30) being oriented transverse to said conveying direction (10) wherein a separating plane (4) is defined which substantially separates said working unit (6) from a top of the apparatus base (2), wherein in said operating position said working unit (6) extends substantially only above said separating plane (4) and the apparatus base (2);

wherein said working unit (6) has at least one assembly runner (68) for positively engaging a counter member (33, 34) of the apparatus base (2) to limit motion of the working unit (6) parallel to said conveying direction (10), means being provided for automatically positively engaging in the counter member (33, 34) under the weight of the working unit (6) only at an end of said insertion motion and upon arriving at said operating position, in said operating position said at least one centering member providing a motion clearance for positionally adjusting said working unit (6) with respect to the apparatus base (2) in an adjusting direction oriented substantially parallel to said conveying direction (10);

wherein drive means (70, 91) are provided for positionally adjusting said working unit (6) when in said operating position, said drive means (70, 91) being provided for adjusting substantially with respect to at least one of a direction parallel to said inserting directions (30), a direction parallel to said conveying direction (10) and a direction around an adjusting axis oriented transverse to said inserting direction and said conveying direction (10); and wherein said drive means (70, 91) include drivably interengaging positioning members (71, 72) provided on said working unit (6), said positioning members (71, 72) including an abutment member having a coupling member for positively positionally and easily detachably connecting said drive means (70, 91) with the apparatus base (2), in said operating position, and working unit (6) being positionally locked with respect to said inserting motion by centering means (33, 34, 68), said drive means (70, 91) being provided to overcome a locking stress of said centering means.

25. An apparatus for working layer material (16) having properties of substrate materials, comprising:

at least one working unit (6) for working the layer material (16), said working unit (6) determining a conveying direction (10) and a general conveying plane (9) for the layer material (116), said working unit (6) including connecting means for operationally and directly connecting said working unit (6) with an apparatus base (2) in an operating position, in said operating position said working unit (6) defining an operational working state, a working station and a working zone, said working unit (6) including at least one base frame unit (84) including said connecting means, wherein said base frame unit (84) is constructed as a subassembly substantially ready for operation for conveying said layer material when assembled with the apparatus base (2), said base frame unit (84) having at least one assembly runner (68) for guiding said base frame unit (84) on the apparatus base (2) during insertion of said base frame unit (84) in a substantially horizontal insertion direction (30) along an insertion path via an insertion motion, said insertion direction (30) being oriented transverse to said conveying direction (10) wherein a separating plane (4) is defined which substantially separates said working unit (6) from a top of the apparatus base (2), wherein in said operating position said working unit (6) extends substantially only above said separating plane (4) and the apparatus base (2);

wherein said apparatus base (2) has a plurality of insertion receptacles (28), said insertion receptacles (28) being arranged in a sequence parallel to said conveying direction (10), each one of said insertion receptacles (28) providing an individual receptacle (28) for autonomously mounting an individual corresponding working unit (6) when in said operating position, wherein said apparatus base (2) includes at least one substantially autonomously operable and supportable first base unit (5) providing at least one of said insertion receptacles (28), at least one second base unit (5) including at least one of said individual receptacles (28), and wherein connecting means (45) are provided for rigidly but detachably interconnecting said first base unit (5) with said second base unit (5), and wherein means are provided for elongating and shortening a working path of said apparatus by adding and removing said second base unit (5), said second base unit (5) being individually connectable to and removable from said apparatus base (2), each working unit (6) being individually connectable to and removable from said apparatus base (2) and said base unit (5), each base unit (5) and each working unit defining an operating module, each first base unit (5) and each second base unit (5) supporting a corresponding load, wherein each load is individually and separately supportable by each respective base unit (5);

wherein for each of said individual receptacles (28) provided on at least one of said first and second base units (5), wherein said base unit (5) includes a separate and individual drive unit (46) including at least one driving input (51) for a drive motor and a driving output (52) for an individual one of said working units (6), said drive unit (46) including positioning means (48) between said input (51) and said output (52) for controlling at least one of a driving direction of said output (52), and a relative positioning between said input (51) and said output (52);

wherein said drive unit (46) includes an angular gear (47) pivotable about said driving output (52) with respect to said apparatus base (2) into two substantially equiaxial revolving positions, said angular gear (47) providing remote connecting members (51) for shaft sections (56), said angular gear (47) further providing a control device (48, 49) for dynamically altering reciprocal rotary positioning between said driving input (51) and said driving output (52).

26. An apparatus for working layer material (16) having properties of substrate materials, comprising:

at least one working unit (6) for working the layer material (16), said working unit (6) determining a conveying direction (10) and a general conveying plane (9) for the layer material (16), said working unit (6) including connecting means for operationally and directly connecting said working unit (6) with an apparatus base (2) in an operating position, in said operating position said working unit (6) defining an operational working state, a working station and a working zone, said working unit (6) including at least one base frame unit (84) including said connecting means, wherein said base frame unit (84) is constructed as a subassembly substantially ready for operation for conveying said layer material when assembled with the apparatus base (2), said base frame unit (84) having at least one assembly runner (68) for guiding said base frame unit (84) on the apparatus base (2) during insertion of said base frame unit (84) in a substantially horizontal insertion direction (30) along an insertion path via an insertion motion, said insertion direction (30) being oriented transverse to said conveying direction (10) wherein a separating plane (4) is defined which substantially separates said working unit (6) from a top of the apparatus base (2), wherein in said operating position said working unit (6) extends substantially only above said separating plane (4) and the apparatus base (2); and wherein said apparatus base (2) includes at least one insertion receptacle (28) for autonomously mounting said working unit (6) when in said operating position, wherein at least a lateral reception member (29) of at least one of said insertion receptacles (28) is positionable with respect to said apparatus base (2) along said conveying direction (10) in a selected one of a plurality of positions, to enable at least one of varying a width extension of said insertion receptacle (28), and varying a positioning of said insertion receptacle (28) along a length extension of said apparatus base (2).

27. An apparatus for working layer material (16) in an operating state while conveying the layer material (16) in a tensioned state along a processing line in general conveying direction (10) oriented substantially horizontal, said apparatus being configured for support on a foundation floor and comprising:

an apparatus base (2) including a dimensionally rigid base frame for supporting said apparatus (1) on the foundation floor, said apparatus (2) extending substantially over said processing line, and a plurality of first and second working stations (6) supported on the top of said apparatus base (2) said working stations being spacedly distributed along said processing line for simultaneously but successively working the layer material (16) by mechanically engaging the layer material (16) extending between said working stations (6), wherein along a division plane oriented transverse to said conveying direction (10) said apparatus base (2) is subdivided into at least two first and second positionally interexchangeable but separably interconnected base units (5), each of said first and second base units (5) separately supporting each of said first and second base units (5) above the foundation floor, said first and second base units (5) each having at least two individual insertion receptacles (28) positioned on top of said first and second base units (5) and spacedly juxtaposed along said processing line for simultaneously mounting and indirectly supporting said first and second working stations (6) exclusively via said first and second base units (5) above the foundation floor, each of said insertion receptacles (28) being provided for simultaneously operably receiving only one of said first and second working stations (6), said working stations (6) being positionally interexchangeable on said insertion receptacles (28) for varying the working of the layer material (16), each of said insertion receptacles (28) providing a support guide for inserting and removing said first working station (6) in an inserting direction (30) oriented substantially horizontally and transverse to said processing line without disconnecting said base units (5) and said second working station (6), said first and second working stations (6) each including a bottom side, at said bottom side of each of said first and second working stations (6) including an assembly runner (68) for supporting and guiding said working station (6) on said support guide during insertion and removal of said working station (6), at said bottom side each of said first and second working stations including station support faces (69) separate from said assembly runner (68) for supporting said working station (6) while machining the layer material (16) and operating said working station (6), wherein said apparatus is modular for elongating and shortening said processing line, for varying a total number of said first and second working stations as provided in said operating state, for varying the product to be processed by said working stations (6) and from the layer material (16), for varying positioning of said working stations (6) along and substantially entirely over said processing line, between said working station (6) and said apparatus base (2) a substantially horizontal separating plane (4) being defined, in said separating plane (4) said support guide including base support faces (31) for directly engaging and supporting said assembly runner (68) during insertion of said working station (6) and for directly engagingly supporting said station support faces (69) when said working station (6) works the layer material (16), said base units (5) not extending above said separating plane (4), when disconnected said base units (5) being separable in a direction parallel to said inserting direction (30).

* * * * *

UNITED STATES PATENT AND TRADEMARK OFFICE

CERTIFICATE OF CORRECTION

PATENT NO. : 5,657,529

DATED : August 19, 1997

INVENTOR(S) : Martin Bohn, et al.

It is certified that error appears in the above-identified patent and that said Letters Patent is hereby corrected as shown below:

At column 2, line 12, "slidein" should be --slide in--.

At column 2, line 58, "sliding in" should read --sliding-in--.

At column 3, line 67, regularable" should be --regulatable--.

At column 21, line 44, "as subassembly substantially" should be --as a subassembly substantially--.

At column 23, line 22, "(116)" should be --(16)--.

At column 25, line 1, --a-- should appear before "general".

Signed and Sealed this

Fifth Day of May, 1998

Bruce Lehman

*Attest:*

BRUCE LEHMAN

*Attesting Officer*

*Commissioner of Patents and Trademarks*